US006702163B1

(12) United States Patent
Hopping

(10) Patent No.: US 6,702,163 B1
(45) Date of Patent: Mar. 9, 2004

(54) BOOT JACK

(76) Inventor: Greg Hopping, 7708 Old Canton Rd., Madison, MS (US) 39110

( * ) Notice: Subject to any disclaimer, the term of this patent is extended or adjusted under 35 U.S.C. 154(b) by 0 days.

(21) Appl. No.: 10/265,762

(22) Filed: Oct. 8, 2002

(51) Int. Cl.[7] ..... A47G 25/80
(52) U.S. Cl. ..... 223/114; 223/113; D2/642
(58) Field of Search ..... 223/114, 113; D2/642

(56) References Cited

U.S. PATENT DOCUMENTS

| | | | | |
|---|---|---|---|---|
| 1,636,010 A | | 7/1927 | Moland | |
| 2,883,097 A | | 4/1959 | Scardamalia et al. | |
| 3,526,346 A | | 9/1970 | Drouillard et al. | |
| 3,623,640 A | * | 11/1971 | Zalejski | 223/114 |
| D224,460 S | | 7/1972 | Wright | |
| D226,245 S | | 1/1973 | Cairns | |
| D286,580 S | | 11/1986 | Stirling | |
| 4,760,942 A | | 8/1988 | Kadar | |
| 5,086,959 A | * | 2/1992 | Jerry et al. | 223/114 |
| 5,133,488 A | | 7/1992 | Peterson | |
| D347,313 S | | 5/1994 | Whitaker | |
| 5,516,015 A | * | 5/1996 | Berzins et al. | 223/115 |
| 5,806,729 A | * | 9/1998 | Ramon | 223/115 |
| 6,135,331 A | | 10/2000 | Davis | |

* cited by examiner

*Primary Examiner*—John J. Calvert
*Assistant Examiner*—James G Smith
(74) *Attorney, Agent, or Firm*—Jacobson Holman PLLC

(57) ABSTRACT

A boot jack which is maintained in position by one foot while the walking boot on the other foot is removed. A V-shaped recess extends from one end of the boot jack. The lower edge of the recess extends parallel to the bottom surface of the boot jack and the ground upon which the boot jack is held as the boot is removed. By arranging the lower edge of the V-shaped recess parallel to the ground, the wearer's foot is moved in a vertical direction while the heel of the boot is retained in the boot jack.

22 Claims, 4 Drawing Sheets

BOOT JACK

FIELD OF THE INVENTION

The present invention relates to a boot jack for facilitating the quick, easy and smooth removal of a boot used for walking, hiking and other activities.

BACKGROUND OF THE INVENTION

Traditional boot jacks involve a complicated maneuver for the removal of walking boots. While one foot maintains the boot jack in a fixed position, the other boot is placed in a recess in the boot jack so as to engage and hold the boot to be removed at an angle of approximately 45 degrees with respect to the ground. In this position, it is often difficult to maintain the position of the boot jack as the boot is being removed. Also, the boot to be removed often slips out from the boot jack and may cause the wearer to fall or loose their balance.

Accordingly, there is a need for a boot jack which quickly, easily and smoothly removes the walking boot of a wearer while the other foot maintains the boot jack in position.

SUMMARY OF THE INVENTION

It is therefore an object of the present invention to provide a boot jack which is maintained in position by one foot while the walking boot on the other foot is removed. This object is accomplished by including a V-shaped recess extending from one end from the boot jack. The lowermost edge of the recess extends parallel to the bottom surface of the boot jack and the ground upon which the boot jack is held as the boot is removed. By arranging the lowermost edge of the V-shaped recess parallel to the ground, the wearer's foot is moved in a vertical direction while the heel of the boot is retained in the boot jack. This smooth upward action, as compared to moving of the leg at an angle of approximately 45 degrees, provides stability to the boot jack while firmly engaging the heel of the boot in the V-shaped recess.

Further, an inwardly projecting lip located at the lowermost edge of the V-shaped recess firmly engages at a gap between the heel and the upper of the boot. This recess tightly grips the space between the heel and the upper of the boot to ensure removal of the boot upon slight upward, vertical movement of the leg of the wearer.

The boot jack itself may be made of plastic or other suitable materials and include a patterned surface on the uppermost surface for gripping the anchoring boot of the wearer. In addition, an upper lip on the V-shaped recess, extending above the upper surface of the boot jack can effectively be used to remove mud and other debris from the sole of the boot.

The V-shaped recess in the boot jack is formed at an angle of between 35 and 40 degrees, preferably at an angle of 37 degrees and most preferably at an angle of 36.9 degrees.

Accordingly, it is another object of the present invention to provide a boot jack having a V-shaped recess with a lowermost edge of the recess extending parallel to the lowermost edge of the boot jack.

It is another object of the present invention to provide a boot jack having a V-shaped recess with a lowermost edge of the recess extending parallel to the lowermost edge of the boot jack with a rib at the lowermost edge of the V-shaped recess projecting inwardly so as to fit within a space between the top of the sole above the heel and below the boot upper.

It is still yet another object of the present invention to provide a boot jack having a V-shaped recess with a lowermost edge of the recess extending parallel to the lowermost edge of the boot jack with a rib at the lowermost edge of the V-shaped recess projecting inwardly so as to fit within a space between the top of the sole above the heel and below the boot upper with the V-shaped recess forming an angle of approximately 35 to 40 degrees between its side walls.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
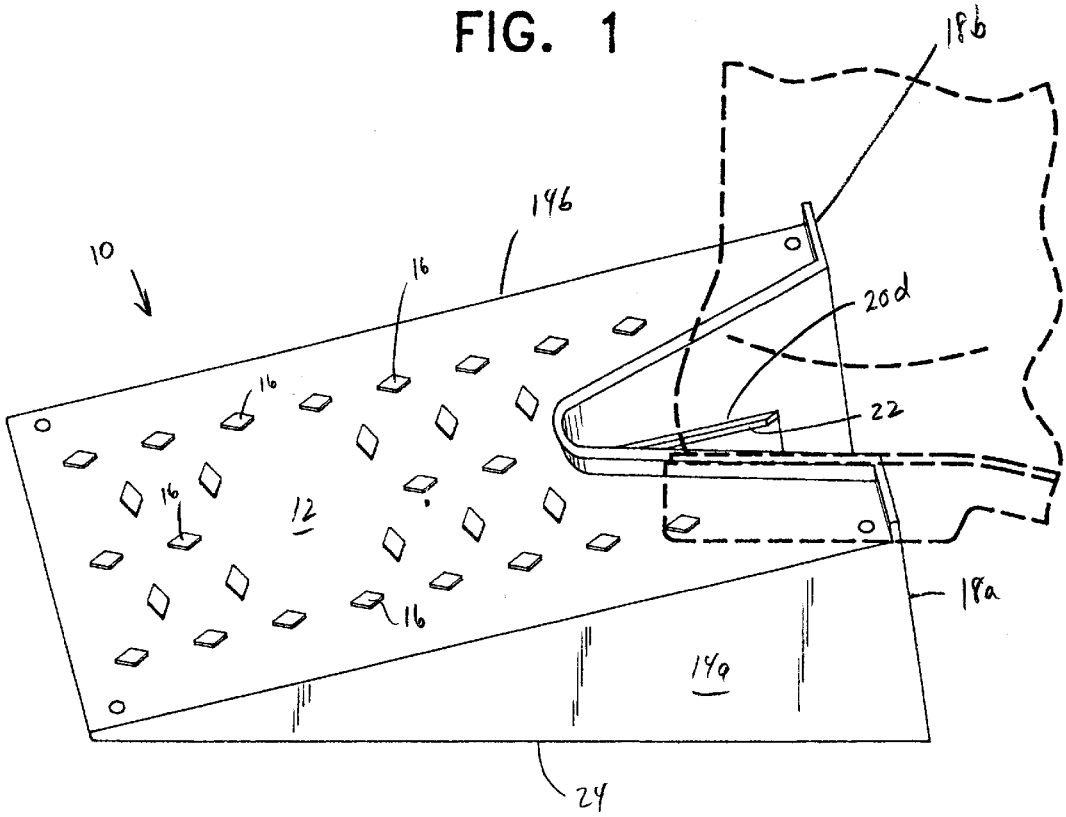
FIG. 1 is a perspective view showing a boot jack of the present invention and including a boot to be removed shown in dotted lines for illustrative purposes.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 7, in particular, a boot jack embodying the teachings of the subject invention is generally designated as 10. With reference to its orientation in FIG. 1, the boot jack includes an upper inclined surface 12 and two parallel vertically extending sidewalls 14*a*, 14*b* located on opposite sides of surface 12.

Upper surface 12 extends at an angle of between 10 and 15 degrees, and preferably 13.6 degrees with respect to the horizontal. On top of the upper surface 12 are a plurality of diamond shaped projections 16 having their longitudinal axis extending parallel to the sidewalls 14*a*, 14*b* or perpendicular to the sidewalls 14*a*, 14*b*.

Each of the projections 16 project approximately 0.040 inches above the surface 12. These projections provide a gripping surface when the upper surface is stepped upon by one foot of the wearer from which a boot is to be removed.

The overall dimensions of the boot jack are 10 inches wide by 20 inches long. The height at the rear surface 18, which is divided into two rear sections 18*a*, 18*b*, is between five and five and one-half inches, and preferably 5.375 inches.

Located between the two rear wall sections 18*a*, 18*b* is a V-shaped recess 20. The V-shaped recess includes sidewall portions 20*a*, 20*b* which converge towards each other and are interconnected by U-shaped portion 20*c*.

At a lower edge 20*d* of the V-shaped recess is located an inwardly projecting rib 22. The rib is located at a height of between two and three inches, and preferably two and one-half inches above the bottom of the boot jack. The rib 22 projects inwardly into an opening defined by the V-shaped recess for a distance of approximately 0.15 to 0.3 inches, and preferably for approximately 0.2 inches. The rib 22 projects from the U-shaped portion 20*c* and along approximately two-thirds of the length of the sidewall 20*a*, 20*b* of the recess 20.

Figure 2:
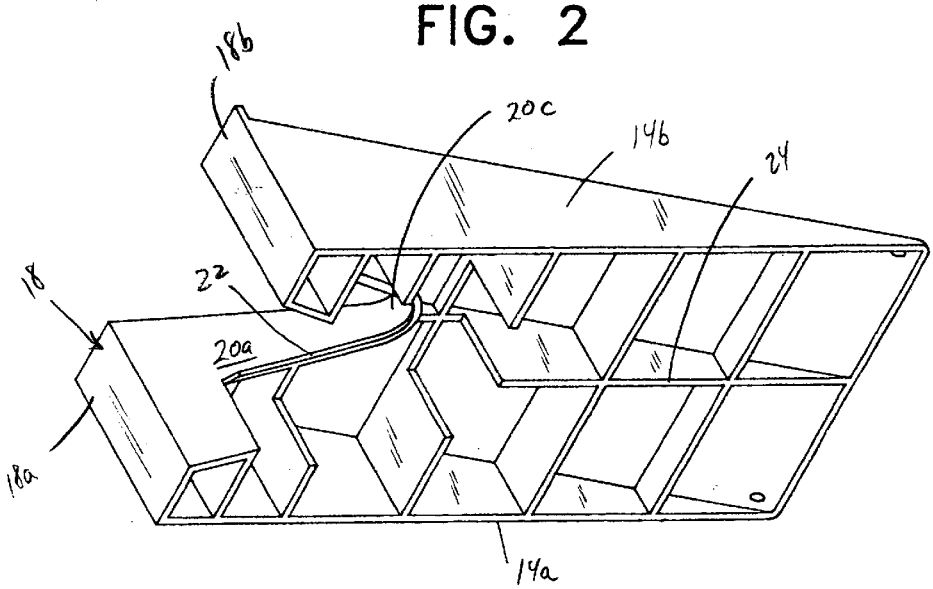
FIG. 2 is a bottom perspective view illustrating the projecting rib at the bottom of the V-shaped recess to facilitate anchoring of a boot in the recess.
Figure 3:
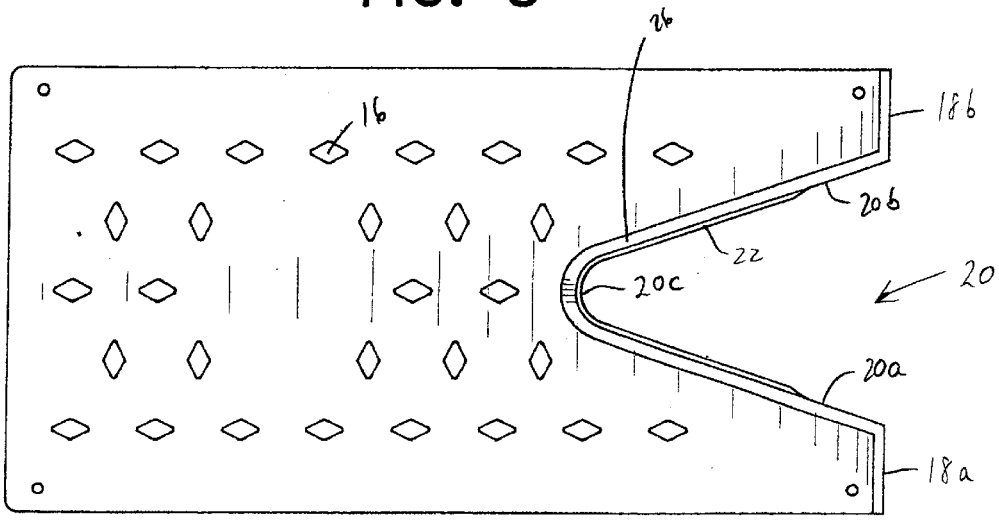
FIG. 3 is a top plan view illustrating the projecting rib and upper lip on the boot jack.
Figure 4:
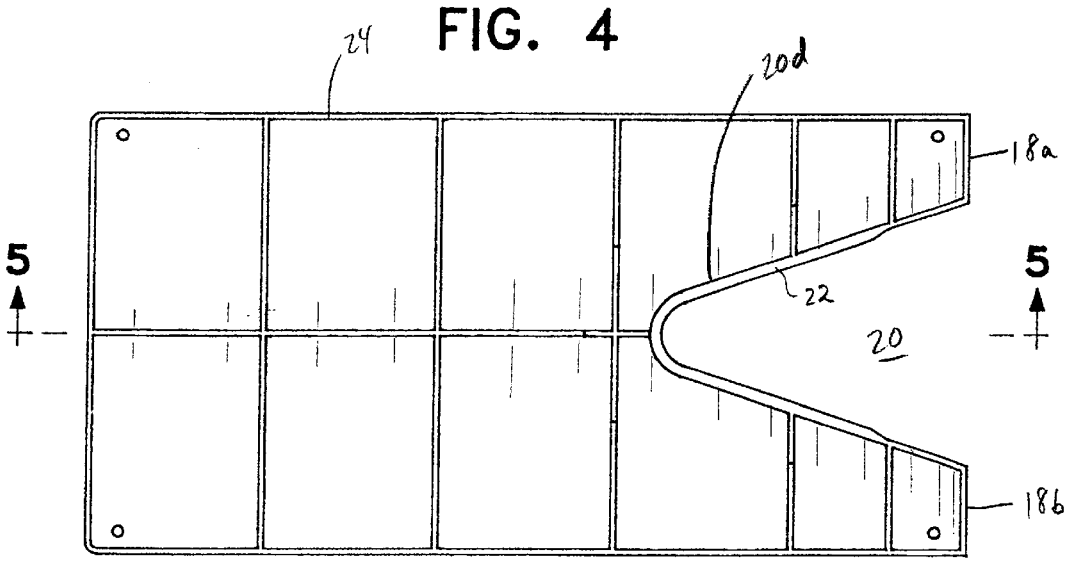
FIG. 4 is a bottom view illustrating the V-shaped recess and its projecting rib.

The projecting rib 22 extends horizontally when the boot jack is placed on the ground and supported by its lowermost edge 24. Lowermost edge 24 is formed by a plurality of vertically extending supports extending downwardly from the uppermost surface 12 as shown in FIGS. 2 and 4. The area below the upper surface 12 is thereby substantially hollow.

Figure 5:
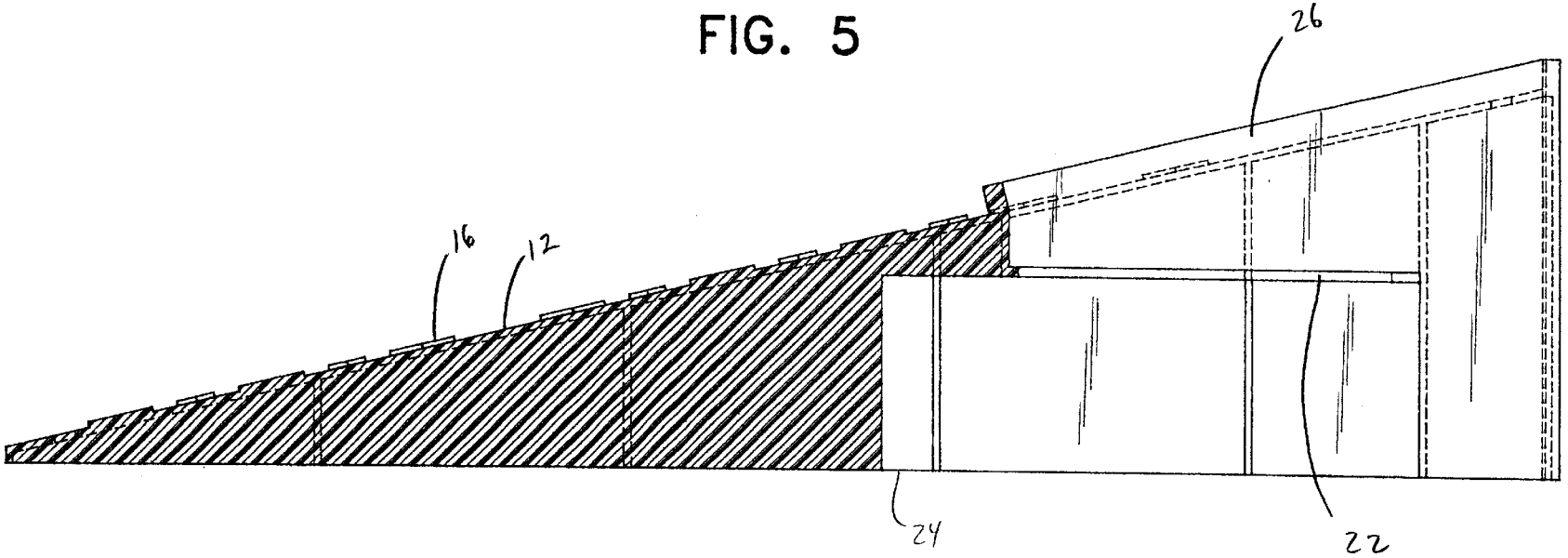
FIG. 5 is a cross sectional view taken along line 5—5 of FIG. 4.
Figure 6:
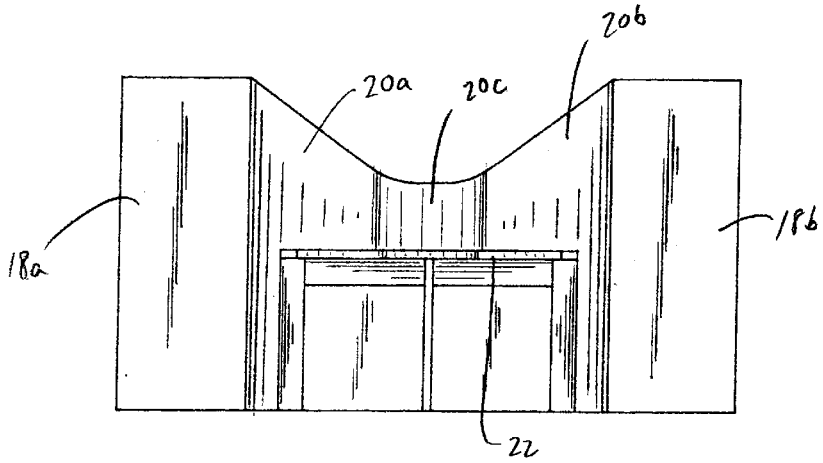
FIG. 6 is a rear view illustrating the V-shaped recess and its projecting rib.
Figure 7:
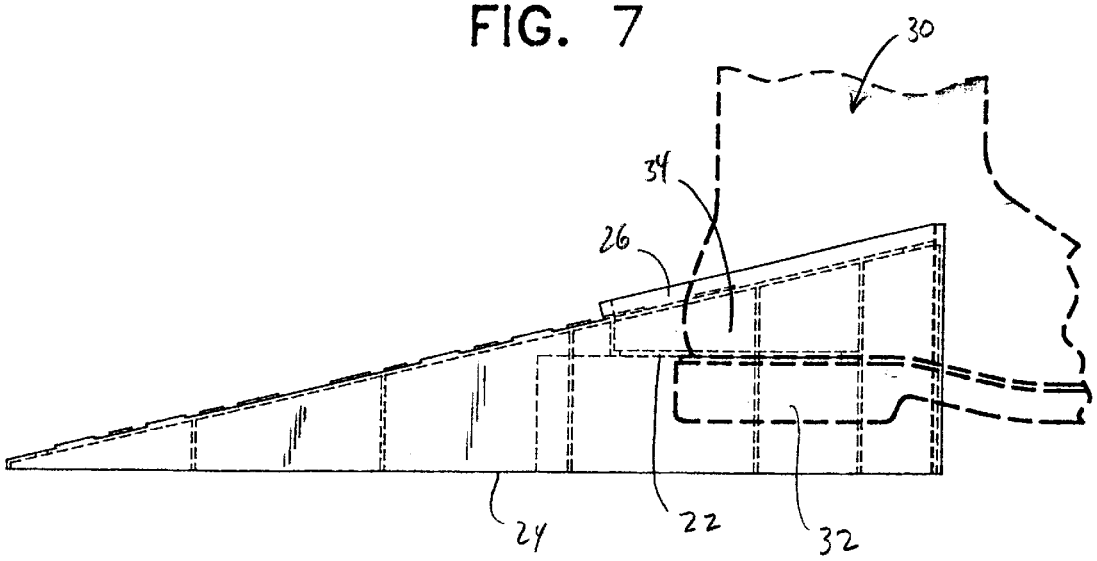
FIG. 7 is a side view illustrating the placement of the boot in the V-shaped recess so that the boot extends approximately parallel to the floor upon which the boot jack rests and for vertical lifting of the leg of the wearer so as to remove the boot from their foot.

At the opposite end of the V-shaped recess portions 20*a*, 20*b*, 20*c* from the projecting rib 22 is an upper lip 26 which extends above the upper surface 12 by 0.364 inches as shown in FIGS. 1, 5 and 7. The upper lip 26 is used for scrapping of mud and debris from the bottom of a boot. The upper lip extends entirely along the perimeter of the V-shaped recess 20 and above the end wall portions 18*a*, 18*b*.

When the rear portion of a boot 30 is inserted into the V-shaped recess 20 as best shown in FIG. 7, the projecting rib 22 is wedged in between the upper portion of the sole at the heel 32 and below the boot upper 34. As shown in FIG. 7, the heel is maintained in a substantially horizontal orientation as the boot is forced rearwardly into the V-shaped recess 20.

While the other foot of the user is placed on the upper surface 12, the leg of the wearer having the boot to be removed is lifted substantially vertically to release the boot from the foot of the wearer. The horizontal orientation of the boot and the vertical lifting of the leg have proven to be especially beneficial in ease of removal of a boot.

The entire assembly of the boot jack may be injection molded of plastic for ease of manufacture at a low cost. The combination of features shown and described facilitates an improved product having advantages over prior boot removal techniques, while affording ease of portability.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A boot jack comprising:

an inclined upper surface supported by a horizontally extending lowermost edge, a V-shaped portion located at an elevated end of the inclined upper surface, and a V-shaped lower edge of the V-shaped portion extending substantially parallel to the lowermost edge of the inclined upper surface so that when the horizontally lowermost edge of the inclined upper surface rests on the ground, the lowermost edge of the inclined upper surface and the lower edge of the V-shaped portion extend parallel to the ground for gripping of the boot by the lower edge of the V-shaped portion.

2. The boot jack as claimed in claim 1, wherein the lower edge of the V-shaped portion includes a projecting rib extending inwardly into an opening defined by the V-shaped portion.

3. The boot jack as claimed in claim 2, wherein an uppermost edge of the V-shaped portion includes a lip for removal of debris.

4. The boot jack as claimed in claim 3, wherein the lip projects above the inclined upper surface.

5. The boot jack as claimed in claim 1, wherein an area below the inclined upper surface is substantially hollow.

6. The boot jack as claimed in claim 1, wherein said inclined upper surface includes a plurality of projections to provide traction to the upper surface.

7. The boot jack as claimed in claim 1, wherein the V-shaped portion defines an angle of between 35 and 40 degrees.

8. The boot jack as claimed in claim 7, wherein the angle is 37 degrees.

9. The boot jack as claimed in claim 2, wherein the projecting rib extends parallel to the lowermost edge of the inclined upper surface.

10. The boot jack as claimed in claim 1, wherein the elevated end of the inclined upper surface has a height of between five and five and one-half inches and the lower edge of the V-shaped portion is located two and one-half inches above the lowermost edge of the inclined upper surface.

11. The boot jack as claimed in claim 1, wherein the inclined upper surface has an inclination of between 10 and 15 degrees.

12. A boot jack for removing a walking boot of an individual, said boot jack comprising:

a body having two ends, an upper surface of the body extending between the two ends, one of the two ends defining a V-shaped opening at a higher end of the two ends for receipt of and wedging of the walking boot to be removed, a lowermost edge of the body defining a flat support surface, the upper surface being inclined with respect to the lowermost edge, a V-shaped portion of the V-shaped opening extending substantially parallel to the flat support surface of the lowermost edge of the body and at an angle with respect to the upper surface for grabbing above the sole and below the upper of the walking boot to be removed and forcing a substantial vertical lifting of the leg having the walking boot for removal of the walking boot.

13. The boot jack as claimed in claim 12, wherein the portion of the V-shaped opening includes a rib projecting into a recess defined by the V-shaped opening.

14. The boot jack as claimed in claim 13, wherein an uppermost edge of the V-shaped opening includes a lip for removal of debris.

15. The boot jack as claimed in claim 14, wherein the lip projects above the inclined upper surface.

16. The boot jack as claimed in claim 12, wherein an area below the inclined upper surface is substantially hollow.

17. The boot jack as claimed in claim 13, wherein said rib extends parallel to the lowermost edge of the body.

18. The boot jack as claimed in claim 12, wherein the elevated end of the inclined upper surface has a height of between five and five and one-half inches and the lower edge of the V-shaped portion is located two and one-half inches above the lowermost edge of the inclined upper surface.

19. The boot jack as claimed in claim 12, wherein the inclined upper surface has an inclination of between 10 and 15 degrees.

20. A boot jack as claimed in claim 12, wherein said V-shaped portion is a lower edge of the V-shaped opening.

21. A boot jack comprising:

an inclined upper surface supported by a horizontally extending lowermost edge, a V-shaped portion located at an elevated end of the inclined upper surface, and a lower edge of the V-shaped portion extending substantially parallel to the lowermost edge of the inclined upper surface, the lower edge of the V-shaped portion includes a projecting rib extending inwardly into an opening defined by the V-shaped portion, the projecting rib extending parallel to the lowermost edge of the inclined upper surface.

22. A boot jack for removing a walking boot of an individual, said boot jack comprising:

a body having two ends, an upper surface of the body extending between the two ends, one of the two ends defining a V-shaped opening at a higher end of the two ends for receipt of and wedging of the walking boot to be removed, a lowermost edge of the body defining a flat support surface, the upper surface being inclined with respect to the lowermost edge, a portion of the V-shaped opening extending substantially parallel to the flat support surface of the lowermost edge and at an angle with respect to the upper surface, the portion of the V-shaped opening including a rib projecting into a recess defined by the V-shaped opening, the projecting rib extending parallel to the lowermost edge of the body for grabbing above the sole and below the upper of the walking boot to be removed and forcing a substantial vertical lifting of the leg having the walking boot for removal of the walking boot.

* * * * *